US006576823B1

(12) United States Patent
Wise, Jr.

(10) Patent No.: US 6,576,823 B1
(45) Date of Patent: Jun. 10, 2003

(54) MUSICAL INSTRUMENT LEG SUPPORT DEVICE

(76) Inventor: Richard K. Wise, Jr., 123 Leffingwell Rd., Uncasville, CT (US) 06382

( * ) Notice: Subject to any disclaimer, the term of this patent is extended or adjusted under 35 U.S.C. 154(b) by 0 days.

(21) Appl. No.: 10/132,816

(22) Filed: Apr. 26, 2002

(51) Int. Cl.[7] ..... G10D 3/00
(52) U.S. Cl. ..... 84/327; 84/421
(58) Field of Search ..... 84/329, 421

(56) References Cited

U.S. PATENT DOCUMENTS

| | | | | |
|---|---|---|---|---|
| 1,261,841 A | | 4/1918 | Mortensen | |
| 1,802,236 A | | 4/1931 | Carroll et al. | |
| 2,814,229 A | | 11/1957 | Vaccaro et al. | |
| 3,979,993 A | * | 9/1976 | Proctor | 84/327 |
| 4,656,917 A | | 4/1987 | Van Halen | |
| D305,097 S | | 12/1989 | Converse | |
| 4,966,062 A | | 10/1990 | Driggers et al. | |
| 5,388,492 A | * | 2/1995 | Olson | 224/910 |
| 5,616,874 A | * | 4/1997 | Kraus | 84/327 |
| 5,817,961 A | * | 10/1998 | Beck | 84/327 |
| D410,669 S | * | 6/1999 | Hamre | 84/327 |

* cited by examiner

*Primary Examiner*—Kim Lockett

(57) ABSTRACT

A musical instrument leg support device for allowing the user of a guitar to more comfortably play a guitar while being seated. The musical instrument leg support device includes a flexible elongate member having a padded member and a non-slip cover member which completely encloses about the padded member; and also includes fastening members each having a strip member being securely attached to a respective end of the flexible elongate member and each having hook and loop fasteners securely attached to the strip member with the musical instrument leg support device being wrapped and fastened about the thigh of the user to prevent slippage of the musical instrument.

5 Claims, 4 Drawing Sheets

FIG. 4
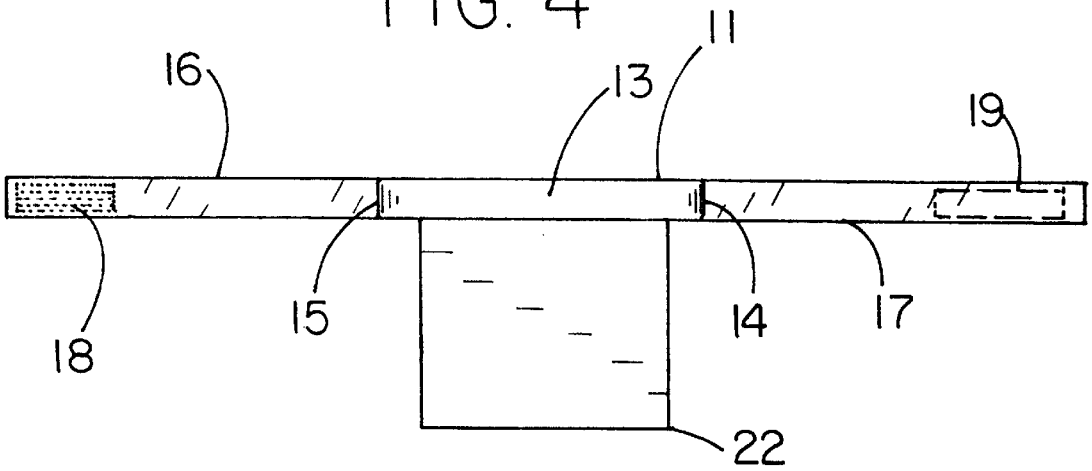
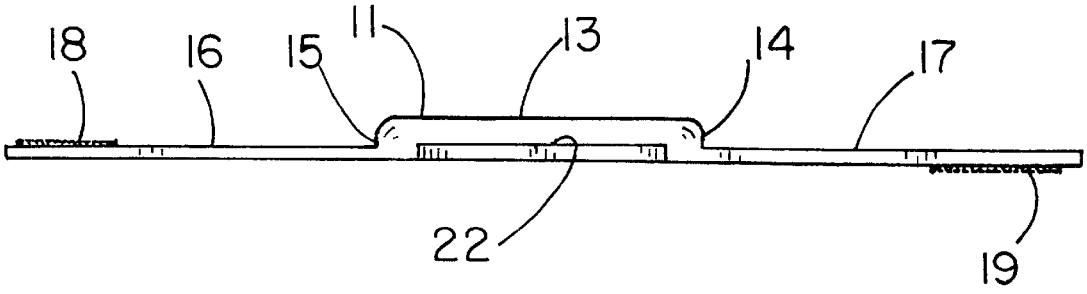
FIG. 5

MUSICAL INSTRUMENT LEG SUPPORT DEVICE

BACKGROUND OF THE INVENTION

1. Field of the Invention

The present invention relates to strap device for supporting a musical instrument and more particularly pertains to a new musical instrument leg support device for allowing the user of a guitar to more comfortably play a guitar while being seated.

2. Description of the Prior Art

The use of strap device for supporting a musical instrument is known in the prior art. More specifically, strap device for supporting a musical instrument heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,979,993; U.S. Pat. No. 1,802,236; U.S. Pat. No. 1,261,841; U.S. Pat. No. 2,814,229; U.S. Pat. No. 5,388,492; and U.S. Pat. No. 4,966,062.

While these devices fulfill their respective, particular objectives and requirements, the aforementioned patents do not disclose a new musical instrument leg support device. The inventive device includes a flexible elongate member having a padded member and a non-slip cover member which completely encloses about the padded member; and also includes fastening members each having a strip member being securely attached to a respective end of the flexible elongate member and each having hook and loop fasteners securely attached to the strip member with the musical instrument leg support device being wrapped and fastened about the thigh of the user to prevent slippage of the musical instrument.

In these respects, the musical instrument leg support device according to the present invention substantially departs from the conventional concepts and designs of the prior art, and in so doing provides an apparatus primarily developed for the purpose of allowing the user of a guitar to more comfortably play a guitar while being seated.

SUMMARY OF THE INVENTION

In view of the foregoing disadvantages inherent in the known types of strap device for supporting a musical instrument now present in the prior art, the present invention provides a new musical instrument leg support device construction wherein the same can be utilized for allowing the user of a guitar to more comfortably play a guitar while being seated.

The general purpose of the present invention, which will be described subsequently in greater detail, is to provide a new musical instrument leg support device apparatus and method which has many of the advantages of the strap device for supporting a musical instrument mentioned heretofore and many novel features that result in a new musical instrument leg support device which is not anticipated, rendered obvious, suggested, or even implied by any of the prior art strap device for supporting a musical instrument, either alone or in any combination thereof.

To attain this, the present invention generally comprises a flexible elongate member having a padded member and a non-slip cover member which completely encloses about the padded member; and also includes fastening members each having a strip member being securely attached to a respective end of the flexible elongate member and each having hook and loop fasteners securely attached to the strip member with the musical instrument leg support device being wrapped and fastened about the thigh of the user to prevent slippage of the musical instrument.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new musical instrument leg support device apparatus and method which has many of the advantages of the strap device for supporting a musical instrument mentioned heretofore and many novel features that result in a new musical instrument leg support device which is not anticipated, rendered obvious, suggested, or even implied by any of the prior art strap device for supporting a musical instrument, either alone or in any combination thereof.

It is another object of the present invention to provide a new musical instrument leg support device which may be easily and efficiently manufactured and marketed.

It is a further object of the present invention to provide a new musical instrument leg support device which is of a durable and reliable construction.

An even further object of the present invention is to provide a new musical instrument leg support device which is susceptible of a low cost of manufacture with regard to both materials and labor, and which accordingly is then susceptible of low prices of sale to the consuming public, thereby making such musical instrument leg support device economically available to the buying public.

Still yet another object of the present invention is to provide a new musical instrument leg support device which provides in the apparatuses and methods of the prior art some of the advantages thereof, while simultaneously overcoming some of the disadvantages normally associated therewith.

Still another object of the present invention is to provide a new musical instrument leg support device for allowing the user of a guitar to more comfortably play a guitar while being seated.

Yet another object of the present invention is to provide a new musical instrument leg support device which includes a flexible elongate member having a padded member and a non-slip cover member which completely encloses about the padded member; and also includes fastening members each having a strip member being securely attached to a respective end of the flexible elongate member and each having hook and loop fasteners securely attached to the strip member with the musical instrument leg support device being wrapped and fastened about the thigh of the user to prevent slippage of the musical instrument.

Still yet another object of the present invention is to provide a new musical instrument leg support device that prevents the musical instrument from slipping upon the user's leg while being seated and while playing the musical instrument.

Even still another object of the present invention is to provide a new musical instrument leg support device that is easy to quickly fasten about the user's leg.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a top plan view, of an embodiment of the present invention.

FIG. 5 is a side elevational view of the embodiment of the present invention shown in FIG. 4.

DESCRIPTION OF THE PREFERRED EMBODIMENT

Figure 1:
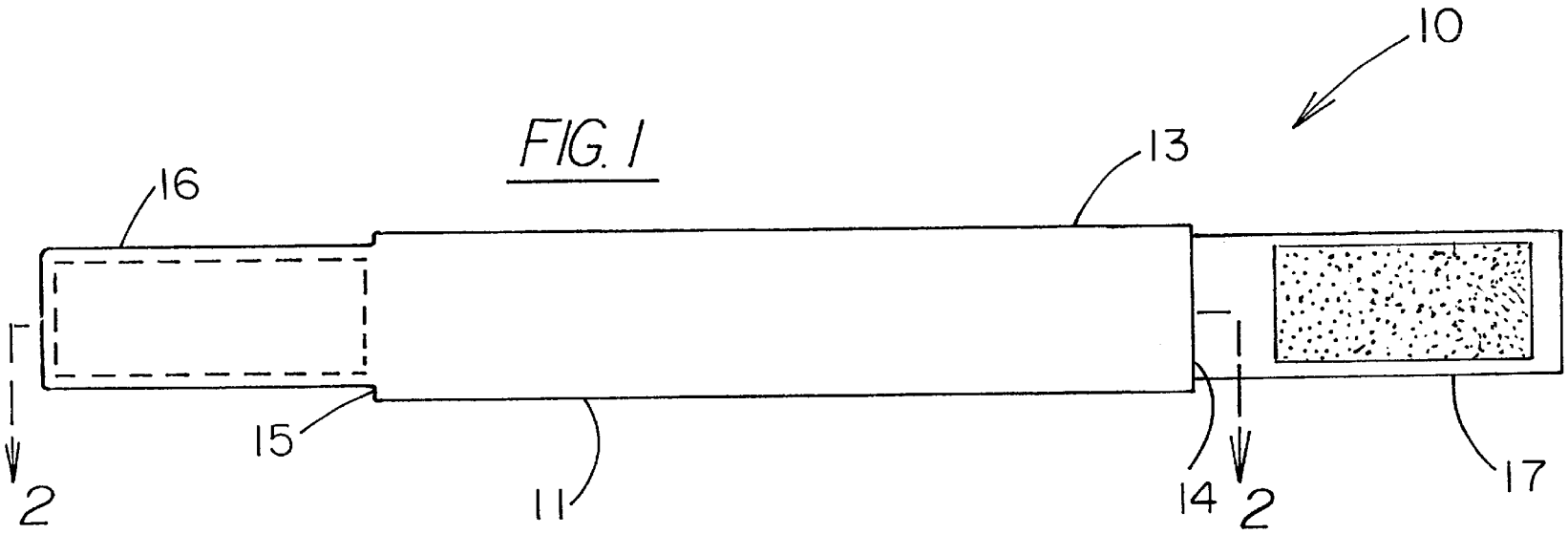
FIG. 1 is a top plan view of a new musical instrument leg support device according to the present invention.
Figure 2:
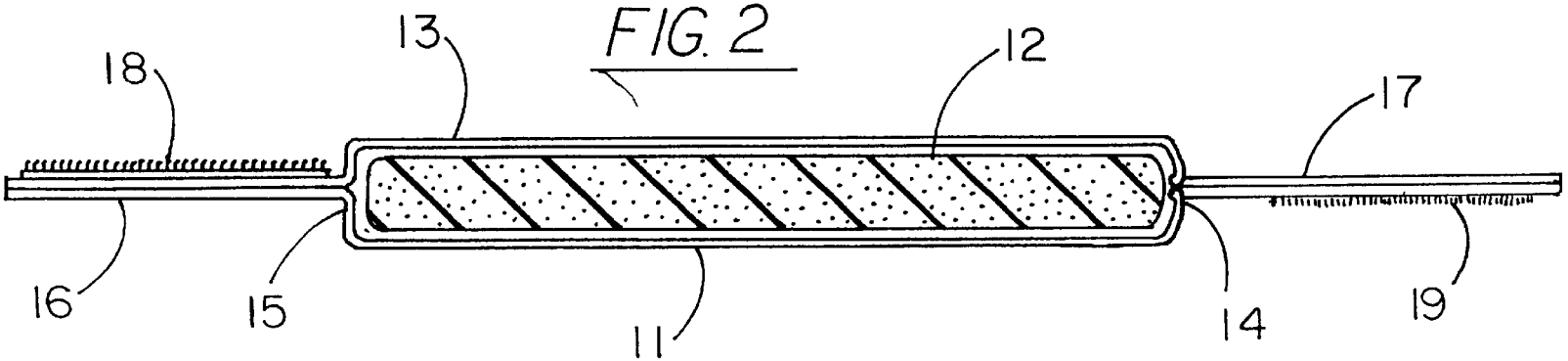
FIG. 2 is a side elevational view of the present invention.
Figure 3:
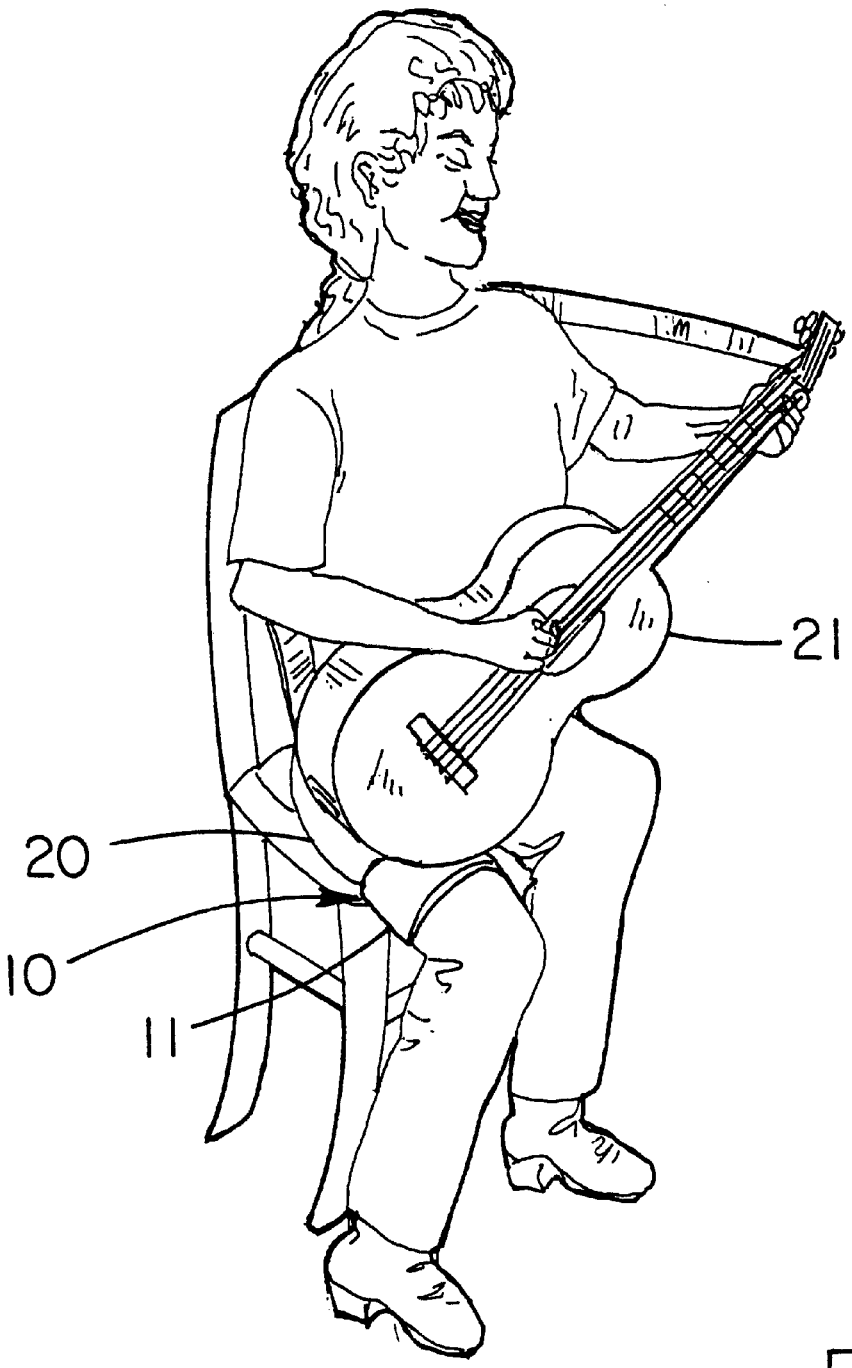
FIG. 3 is a perspective view of the present invention shown in use.

With reference now to the drawings, and in particular to FIGS. 1 through 7 thereof, a new musical instrument leg support device embodying the principles and concepts of the present invention and generally designated by the reference numeral 10 will be described.

As best illustrated in FIGS. 1 through 7, the musical instrument leg support device 10 generally comprises a flexible elongate member 11 having a definite thickness and being adapted to fasten about a user's thigh 20 and being adapted to prevent a musical instrument 21 from sliding or moving upon the user's leg 20. The flexible elongate member includes a padded member 12 and a non-slip cover member 13 made essentially of neoprene and being securely and conventionally enclosed about the padded member 12 with the flexible elongate member 11 essentially forming a barrier and an abutment upon the user's leg 20 and against which the musical instrument 21 rests. The flexible elongate member 11 is adapted to extend upwardly from the user's leg 20 and has a length adapted to extend over a front of the user's thigh 20 with the padded member 12 having a width of approximately 2¼ inches, length of approximately 16 inches and a thickness of approximately 1¾ inches. A plurality of fastening members are securely and conventionally attached to ends 14,15 of the flexible elongate member 11 for fastening the flexible elongate member 11 about the user's leg 20. Each of the fastening members includes a strip member 16,17 having an end securely and conventionally attached to a respective end of the flexible elongate member 11, and further includes a plurality of hook and loop fasteners 18,19 securely and conventionally attached to the strip member 16,17 for fastening about the user's leg 20.

Figure 6:
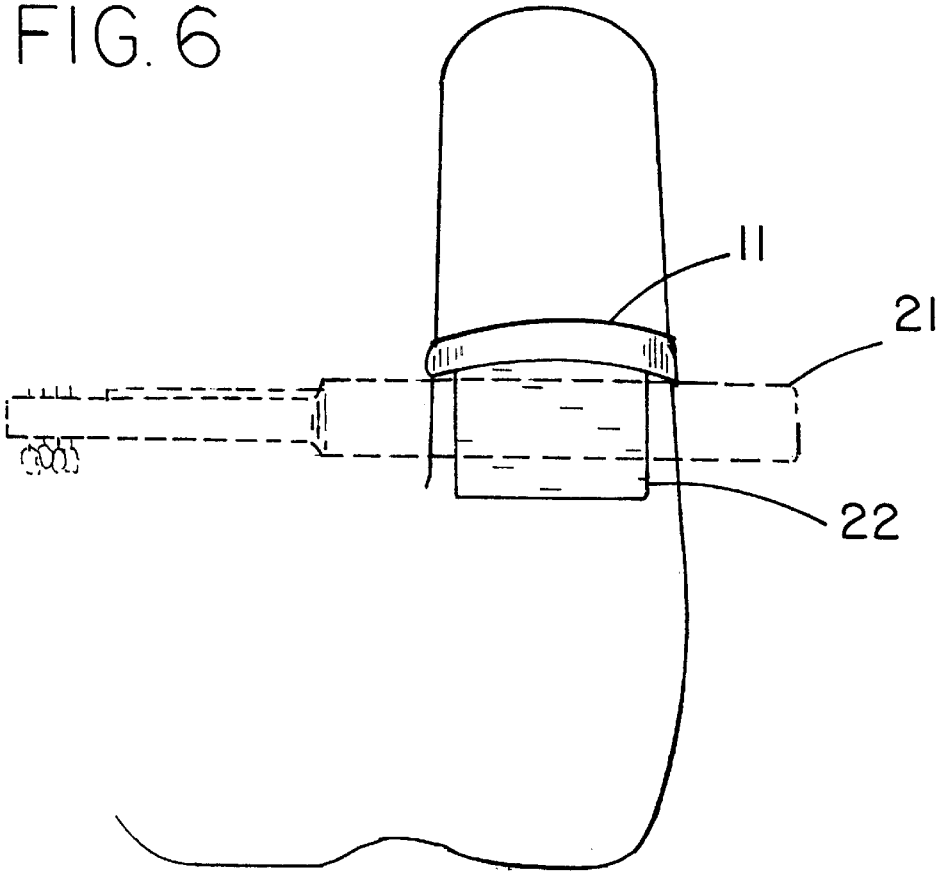
FIG. 6 is a top plan view of the embodiment of the present invention shown in FIG. 4 in use.

In an embodiment, as shown in FIGS. 4 through 6, a flap member 22 is coupled to the flexible elongate member 11 whereby the flap member 22 is positioned over the thigh of the user when the flexible elongate member 11 is fastened around the thigh of the user. The flap member 22 comprises a friction enhancing material whereby the friction enhancing material is designed for inhibiting the guitar from sliding off of the thigh of the user.

Figure 7:
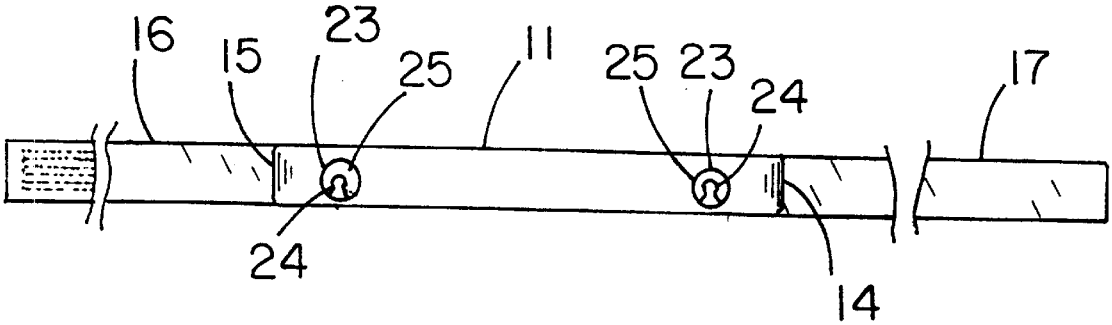
FIG. 7 is a top plan view of another embodiment of the present invention.

In another embodiment, as shown in FIG. 7, a pair of holding portions 23 are coupled to a surface of the flexible elongate member 11. Each of the holding portions 23 is designed for holding a guitar pick when the user is playing the guitar. Each of the holding portions 23 has a cutout 24 positioned on a front face 25 of the respective one of the holding portions 23. The cutout 24 of each of the holding portions 23 is designed for facilitating retrieval of the guitar pick by the user when the guitar is being held by the user.

In use, the user extends or wraps the leg support device 10 about one's thigh 20 with the flexible elongate member 11 being disposed upon the front of the thigh 20 and with the strip members 16,17 being fastened to one another to secure the leg support device 10 about the user's leg 20. The user then supports the musical instrument 21 such as a guitar upon one's thigh 20 having the leg support device 10 and rests the musical instrument 21 against the flexible elongate member 11 which substantially prevents the musical instrument 21 from sliding down the user's leg 20 during the playing of the musical instrument 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are, deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A musical instrument leg support device comprising:

a flexible elongate member having a definite thickness and being adapted to fasten about a user's thigh and being adapted to prevent a musical instrument from sliding or moving upon the user's leg;

a plurality of fastening members being securely attached to ends of said flexible elongate member for fastening said flexible elongate member about the user's leg;

said flexible elongate member including a padded member and a non-slip cover member being securely enclosed about said padded member, said flexible elongate member essentially forming a barrier and an abutment upon the user's leg and against which the musical instrument rests;

said flexible elongate member being adapted to extend upwardly from the user's leg and has a length adapted to extend over a front of the user's thigh; and each of said fastening members includes a strip member having an end securely attached to a respective said end of said flexible elongate member, and further includes a plurality of hook and loop fasteners securely attached to said strip member for fastening about the user's leg.

2. A musical instrument leg support device as described in claim 1, wherein said padded member has a width of approximately 2¼ inches, length of approximately 16 inches and a thickness of approximately 1¾ inches.

3. A musical instrument leg support device comprising:

a flexible elongate member having a definite thickness and being adapted to fasten about a user's thigh and being adapted to prevent a musical instrument from sliding or moving upon the user's leg;

a plurality of fastening members being securely attached to ends of said flexible elongate member for fastening said flexible elongate member about the user's leg; and a pair of holding portions being coupled to a surface of said flexible elongate member, each of said holding portions being adapted for holding a guitar pick when the user is playing the guitar.

4. A musical instrument leg support device as described in claim 3, wherein each of said holding portions has a cutout positioned on a front face of the respective one of said holding portions, said cutout of each of said holding portions being adapted for facilitating retrieval of the guitar pick by the user when the guitar is being held by the user.

5. A musical instrument leg support device comprising:

a flexible elongate member having a definite thickness and being adapted to fasten about a user's thigh and being adapted to prevent a musical instrument from sliding or moving upon the user's leg;

a plurality of fastening members being securely attached to ends of said flexible elongate member for fastening said flexible elongate member about the user's leg; and a flap member being coupled to said flexible elongate member such that said flap member is positioned over the thigh of the user when said flexible elongate member is fastened around the thigh of the user, said flap member comprising a friction enhancing material such that said friction enhancing material is adapted for inhibiting the guitar from sliding off of the thigh of the user.

* * * * *